US007588272B2

(12) United States Patent
Gephart

(10) Patent No.: US 7,588,272 B2
(45) Date of Patent: Sep. 15, 2009

(54) DOOR HANDLE ASSEMBLY

(75) Inventor: John D Gephart, Rocky Hill, CT (US)

(73) Assignee: National Manufacturing Co., Sterling, IL (US)

( * ) Notice: Subject to any disclaimer, the term of this patent is extended or adjusted under 35 U.S.C. 154(b) by 328 days.

(21) Appl. No.: 11/030,321

(22) Filed: Jan. 7, 2005

(65) Prior Publication Data

US 2006/0152020 A1 Jul. 13, 2006

(51) Int. Cl.
*E05B 3/00* (2006.01)

(52) U.S. Cl. ..... 292/336.3; 292/348; 292/342; 292/DIG. 53; 292/DIG. 64

(58) Field of Classification Search ..... 292/336.3, 292/348, 342, 350, 351, 356, 357, DIG. 2, 292/DIG. 53, DIG. 64; 70/466, 451, 224
See application file for complete search history.

(56) References Cited

U.S. PATENT DOCUMENTS 2,759,754 A * 8/1956 Kaiser ..... 292/347
3,035,432 A * 5/1962 De Vines ..... 70/216
3,072,427 A * 1/1963 De Vines ..... 292/169.22
3,107,113 A 10/1963 Sconzo
3,228,218 A * 1/1966 Wilson ..... 70/475
4,432,576 A 2/1984 Wartian
4,732,418 A 3/1988 Crown et al.
4,739,537 A 4/1988 Wilke
5,056,835 A 10/1991 Johnson
5,761,936 A 6/1998 Katayama
5,762,387 A * 6/1998 Edgerly et al. ..... 292/357
5,941,108 A 8/1999 Shen
6,302,457 B1 10/2001 Shen
6,357,808 B1 3/2002 Supernat
6,619,710 B1 * 9/2003 Hwang ..... 292/336.3
6,655,108 B2 12/2003 Larson et al.
6,698,260 B2 * 3/2004 Su ..... 70/134
6,893,059 B2 * 5/2005 Shen ..... 292/169
7,066,507 B2 * 6/2006 Don ..... 292/336.3
7,077,437 B2 * 7/2006 Huang ..... 292/336.3
7,082,794 B2 * 8/2006 Shen et al. ..... 70/224

FOREIGN PATENT DOCUMENTS

DE 32 04 889 A1 9/1983

* cited by examiner

*Primary Examiner*—Peter M. Cuomo
*Assistant Examiner*—Mark Williams
(74) *Attorney, Agent, or Firm*—Pillsbury Winthrop Shaw Pittman LLP

(57) ABSTRACT

A door handle assembly comprises a handle mount having an opening therethrough and a manually engageable handle rotatable about an axis, the axis aligned with the opening positioning structure is fixed relative to the handle mount. The positioning structure has a plurality of locking regions defined by locking surfaces, the locking regions being spaced at predefined distances from the axis. A pair of mounting studs, are adapted to extend through an associated pair of apertures in a door. The mounting studs have lock surfaces that are engageable with the spaced locking surfaces of the positioning structure to enable the elongated mounting studs to be selectively fixed relative to the positioning structure at desired predetermined distances from the axis.

14 Claims, 6 Drawing Sheets

DOOR HANDLE ASSEMBLY

BACKGROUND OF THE INVENTION

The present invention relates to a door handle assembly and more specifically to an improved door handle assembly having mounting studs capable of being selectively adjusted and securely held at one of the predetermined fixed positions, which enable positioning of mounting studs of the door handle assembly to be installed, in direct alignment with standard positions of holes that are found in different doors.

Door handle assemblies are commonly known in the art and are substantially used for installation on different types of doors. The door handle assemblies generally comprise a rotatable handle having a locking mechanism, a handle mount and a faceplate. Door handle assemblies may be used for installation on either newly manufactured doors or currently installed doors which require replacement of an existing door handle assembly. The door handle assemblies are generally installed on doors by aligning the holes in the door handle assembly with the holes in the door and securing the fasteners through aligned holes.

The spacing between the holes in the door varies for different types of door handles, but generally the spacing is fixed at one of three standard sizes, namely 1.5", 1.75" or 3.0", located symmetrically about a central spindle aperture. This variation in standard spacing limits the functional adaptability of the door handle assembly for differently prepared types of doors and requires an inventory of door handle assemblies having different size of spacing between the holes. Alternatively, in case of mismatch of spacing between the holes of a door handle assembly to be installed and the spacing between the holes available in the door, new holes must be drilled through the door.

U.S. Pat. No. 5,762,387, hereby incorporated by reference, discloses a universal latch wherein two mounting studs are provided, which are adjustable relative to the spindle position. These adjustable mounting studs enable installation of the latch assembly in alignment with the existing holes of the door, thereby enhancing the functional adaptability of the door latches and obviating the need for drilling new holes in the door. The mounting studs have square flats at one end, which are positioned in the recess between the track plate and the planar wall of the faceplate of the knob housing subassembly. The shanks of the mounting studs, which extend outwardly through the elongated slots of the track plate, are internally threaded thus permitting fasteners to be fixed in alignment with the holes of the door, for joining knob housing subassembly on one side of the door to the latch subassembly on the other side of the door.

However, the latch assembly described in the above cited US patent has the limitation that the mounting studs must be accurately adjusted in the slotted regions of the track plate so as to align the spacing between the mounting studs with the spacing between the holes in the door, which in turn depends upon the type of door used.

Accordingly, it is an object of the present invention to provide an improved adjustable novel door handle assembly.

BRIEF DESCRIPTION OF THE DRAWINGS

The detailed description of the preferred embodiments of the present invention is made with reference to accompanying drawings. It is to be understood that the drawings illustrate specific embodiments in which the present invention may be practiced and are not intended to be taken restrictively to limit the scope of the invention to the embodiments illustrated. The principles and features of the present invention can be embodied in variant embodiments by making equivalent structural changes and adaptations, without departing from the scope of the present invention. In the accompanying drawings:

FIG. 4(*b*) is a side view of the locking of a mounting stud into one of the locking regions of the positioning plate of FIG. 2;

FIG. 4(*c*) is a magnified perspective view of the locking of the corners of diamond-shaped disc of one of the mounting studs into the corners of one of the locking regions of the positioning plate of FIG. 2;

FIG. 6(*b*) is the knob member of the locking mechanism of the second door handle assembly of FIG. 6(*a*)

DETAILED DESCRIPTION OF THE PREFERRED EMBODIMENT

Figures 1, 2:
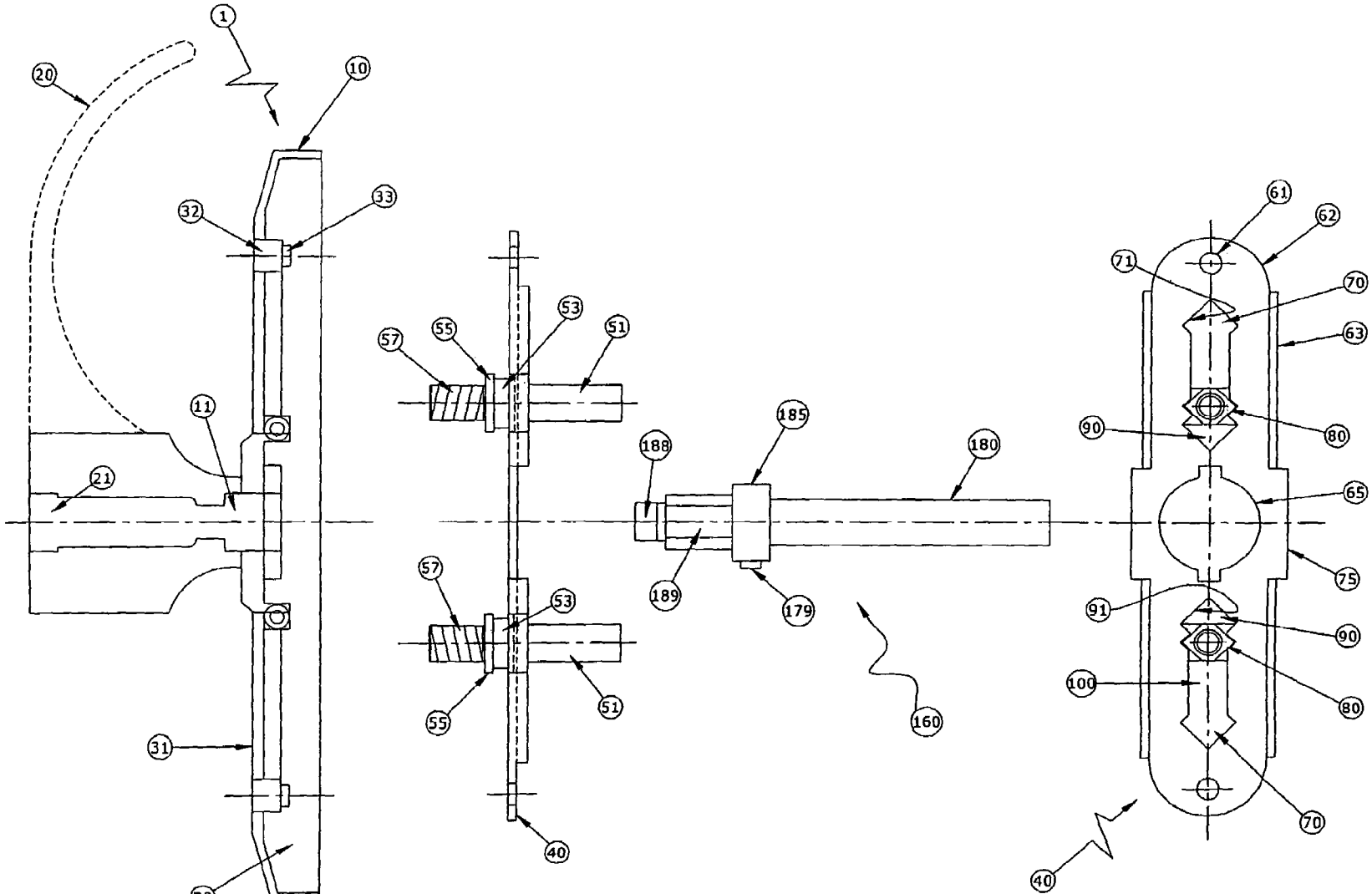
FIG. 1 is a partially exploded side elevation view of the first door handle assembly of the present invention.
FIG. 2 is a side elevation view of the positioning structure of the first door handle assembly of FIG. 1.

Referring to FIG. 1, the door handle assembly 1 embodying the present invention includes a handle escutcheon or handle mount 10 having an opening 11 therethrough. A manually engageable handle 20 is seated in the opening 11 of the external planar surface 31 of the handle mount 10. The handle 20 has also an opening 21 therethrough and is rotatable about an axis, which is aligned with the axis of the opening 11. The handle escutcheon 10 has a perpendicular wall 30, which extends around the periphery of its planar surface 31. The wall 30 together with planar surface 31 form a cavity, wherein a pair of solid cylindrical posts 32 are provided near its two ends, with one post being on one side of the opening 11 and other post being on the other side of the opening 11. A pair of projecting pins 33 is integrally provided over the surface of the pair of posts 32. The projecting pins 33 are cylindrical in shape, have their axis aligned with and have smaller diameter than the posts 32 and are capable of being deformed.

Figures 4, 4A, 4B, 4C:
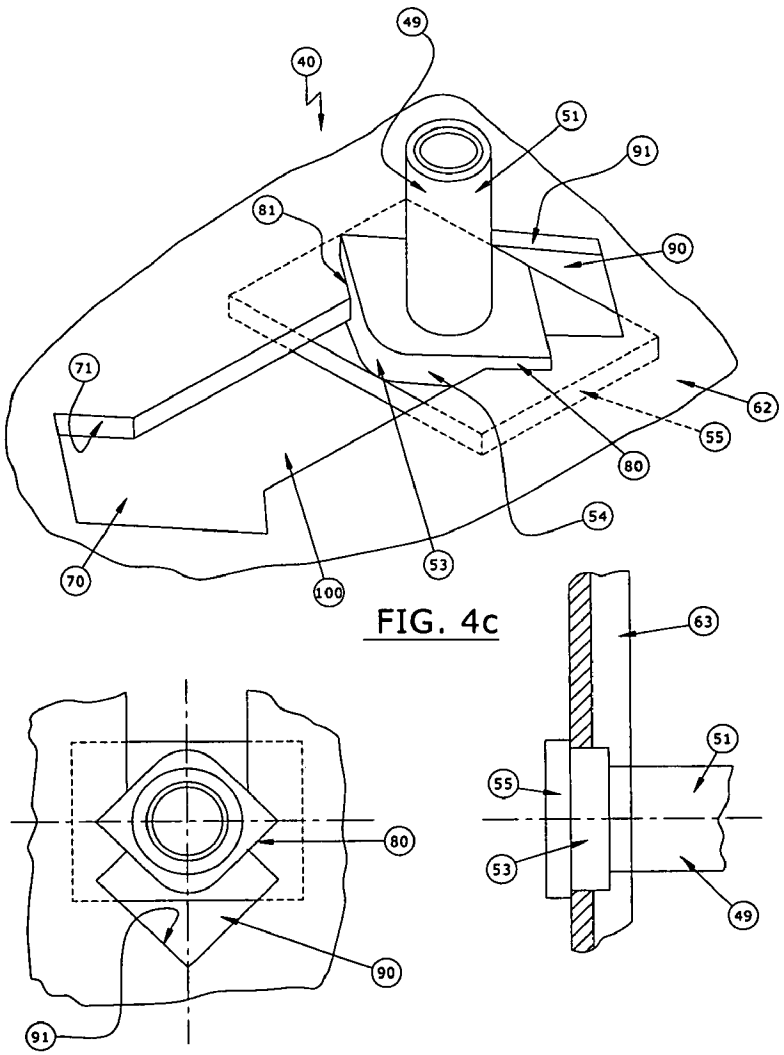
FIG. 4(*a*) is a detail partial elevation view of the locking of a mounting stud into one of the locking regions of the positioning plate of FIG. 2.

A pair of mounting studs 51 having a generally T-shaped profile is provided inside the cavity between the wall 30 and planar surface 31. One member of the pair of mounting studs 51 is positioned on one side of the opening 11 and other member of the pair is positioned on the other side of the opening. As best seen in FIG. 4(*c*), the head portion of each mounting stud 51 has a generally diamond-shaped locking portion 53 with peripheral size larger than that of the shank portion 49 of the stud. Each stud has also rectangular flats 55. A pair of springs 57 is operatively connected underneath a respective head portion of each of the mounting studs. When the mounting studs are in locked state in a locking region of positioning structure or plate 40, the springs 57 maintain the diamond-shaped locking portion 53 of the mounting studs in non-rotating engagement with one of the locking regions of the positioning plate as will be described.

Figure 3:
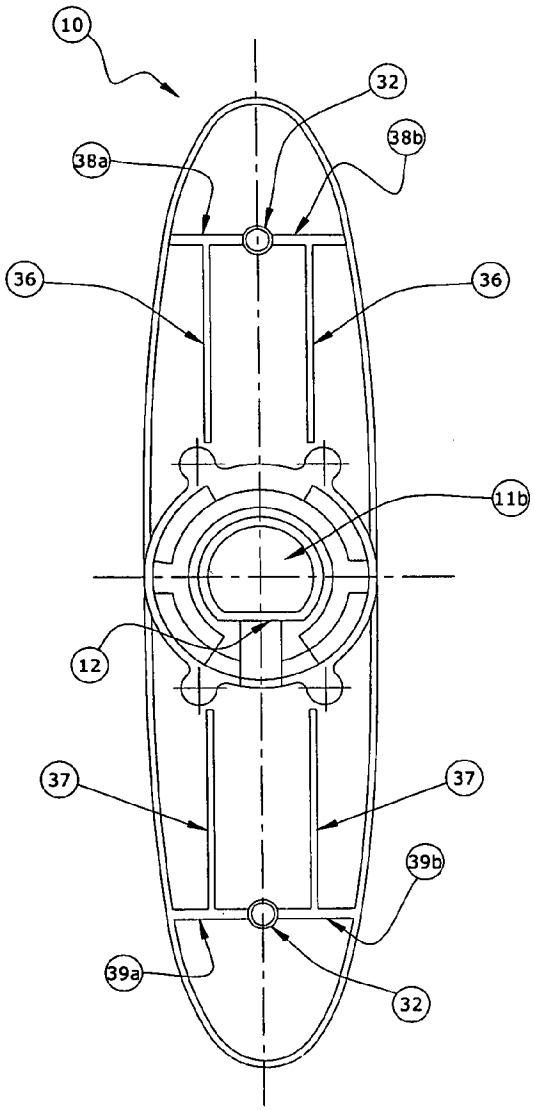
FIG. 3 is a side elevation view of the handle mount with positioning plate removed.

A hollow cylindrical spindle 180 is adapted to telescopically interconnect the first door handle assembly with the second door handle assembly which will be described. The spindle has a lock collar member 185 around its external circular periphery having locking pin 179. The lock collar member is located at about one-fourth of its length, dividing its external periphery into a longer part and a shorter part. The shorter part of spindle surface has a flattened surface 189 on one side, which matches with the flattened surface 12 of the opening 1*b* of the first handle 20 and is dimensionally aligned with the opening 11*b* (FIG. 3). When the spindle 180 is inserted into the opening 11*b*, aligning its flattened surface 189 with flattened surface 12, it becomes well seated into the opening 11*b* and the door handles of the two door handle assemblies rotate only as a unit.

Turning to FIG. 2, the positioning structure 40, which in one embodiment may have a plate-like configuration as shown, is cooperatively configured and dimensioned to sit snugly within the cavity formed by wall 30 and planar surface 31. The positioning plate 40 has a pair of apertures 61 near its two ends. The apertures 61 are so dimensioned that when the positioning plate is placed in the cavity, the pins 33 tightly pass through the apertures 61. The positioning plate is secured in the cavity by deforming the pins 33. The positioning plate 40 has a central aperture 65 corresponding to the opening 11 of the handle escutcheon 10. The positioning plate 40 has elongated planar sides 62 and stiffening flanges 63 along the planar sides 62. Planer square section 75 separates the flanges 63 near the aperture 65.

The positioning plate 40 has a pair of elongated slots 100, one on each side of aperture 65 and equidistant from the axis of the aperture 65. The elongated slots have three pair of locking regions 70, 80 and 90, with a member of each pair being on one side and the other member of each pair being on the other side of the aperture 65. The locking regions are also equidistant from the axis of the aperture 65. The locking region pair (90, 90) is spaced apart by a distance of 1.5", the locking region pair (80, 80) is spaced apart by a distance of 1.75" and locking region pair (70, 70) is spaced apart by a distance of 3". The spacing between each of the locking regions corresponds to the standard distance between the pair of holes generally found in different doors. However, by suitably designing the positioning plate, particularly the elongated slots 100 and the locking regions therein, the number of locking regions and distance between any two members of a locking region can be made to any predetermined requirement.

Referring to FIG. 3, two pairs of identical partitioning walls (38*a*, 38*b*) and (39*a*, 39*b*) are integrally provided on the inner surface of the planar surface 31, under the positioning plate 40. These two pair of partitioning walls are perpendicular to the inner side of the planar surface 31, and are diametrically opposite across the two posts 32. Another two pairs of parallel partitioning walls, 36 and 37, which are also integrally provided on the inner surface of the planar surface 31, are at right angles to the pair of walls (38*a*, 38*b*) and (39*a*, 39*b*) respectively. The opening 11*b* in handle 20 is cylindrical in shape with a flattened planar surface 12 on one side.

Turning to FIG. 4*a*-4*c*, the positioning plate 40 is secured in cavity 30 and the mounting studs 51 are located therebetween. The shanks 49 of the pair of mounting studs 51 extend outwardly through elongated slots 100 or any of the locking regions (70, 80, 90) thereof. The shanks 49 are hollow, open at a distal end thereof; and are internally threaded, so as to receive an externally threaded fastener as will be described. The head portion with rectangular flats 55 of the mounting studs being sized larger than the size of the elongated slots and also being sized larger than the internal periphery of the locking regions, remains disposed within the recess between the planer surface 62 of the positioning plate and the planar surface 31 of the handle escutcheon 10. This makes the mounting studs adjustable in the recess between the positioning plate and the planar surface 31.

The internal surfaces 71, 81, 91 of any of the locking regions (70, 80, 90) of the positioning plate (referred to hereinafter as the locking surfaces of the positioning plate) and the external periphery 54 of locking portion 53 of the mounting stud 51 are complementary in shape. So that when the mounting studs are adjusted and positioned into any of the predetermined locking regions, the locking surface 54 of the mounting studs becomes engaged into locking surface 71, 81 or 91 of the locking regions (70, 80 or 90) and is unable to rotate. Thus the mounting studs are capable of being manually engaged with the locking surfaces 71, 81 or 91 of the positioning plate and the mounting studs can be secured at the predetermined distance between mounting studs. Once the locking surfaces 54 of the mounting studs and the locking surface 71, 81 or 91 of the locking regions are engaged with each other, the springs 57 operatively connected underneath the rectangular flats 55, maintain the mounting studs in engagement with the locking regions. For example, if the door handle assembly of the present invention is to be installed on a door having existing holes spaced apart by a distance of 1.75", the mounting studs are adjusted and one mounting studs is positioned at locking region 80 on one side of aperture 65 and other mounting stud is adjusted and positioned at the locking region 80 on other side of the aperture 65. The engagement of the locking surface of a mounting stud with locking surface of a locking region of the positioning plate is illustrated in FIG. 4 (*a*) and FIG. 4(*b*). The corners of the diamond-shaped locking portion 53 of the mounting studs become locked into the corners of the locking region as illustrated in FIG. 4(*c*).

Figure 5:
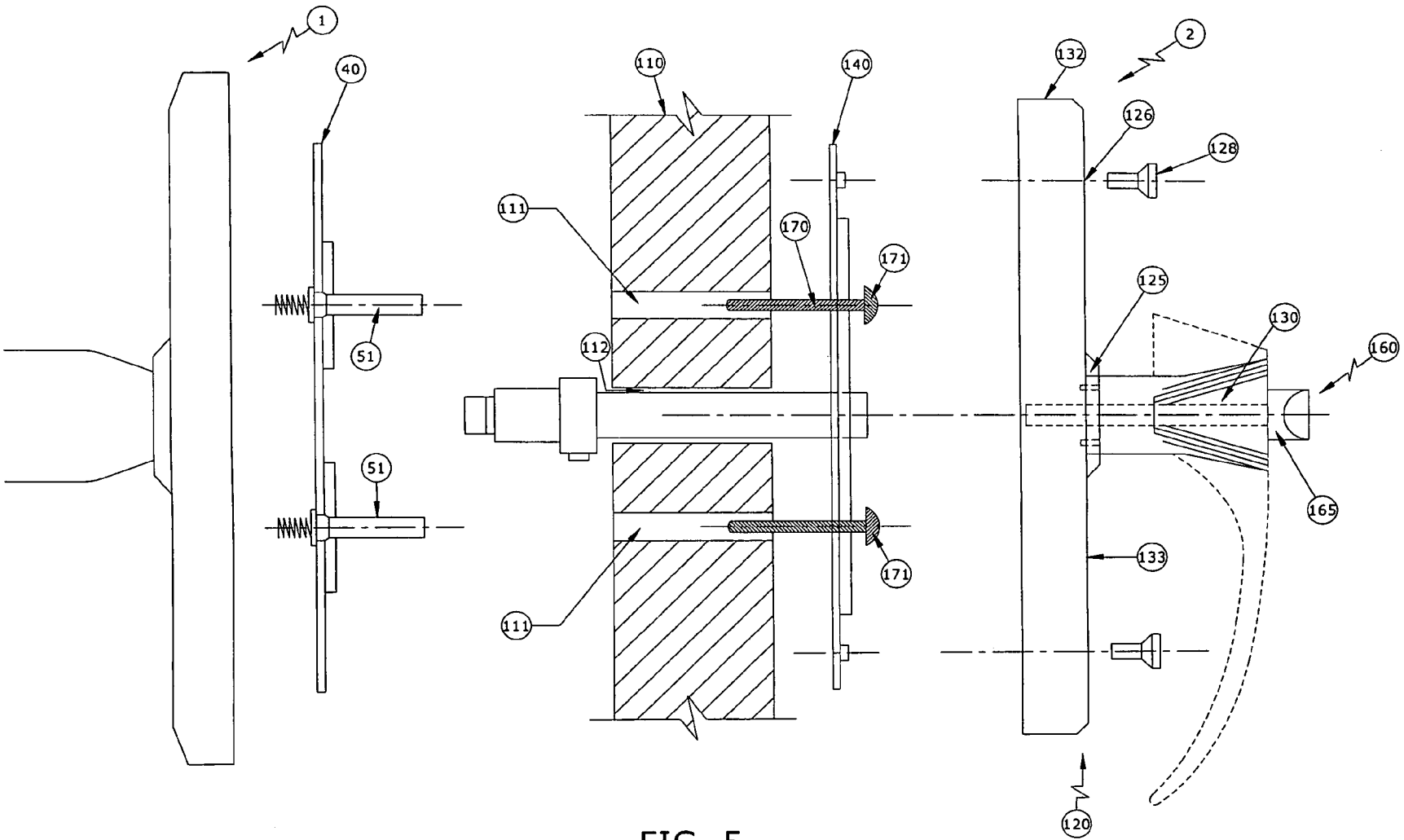
FIG. 5 is a partially exploded side elevation view of first door handle assembly of FIG. 1, positioned to be mounted on one side of a fragmentarily illustrated door in section and second door handle assembly with locking mechanism, on other side of the door.
Figure 6:
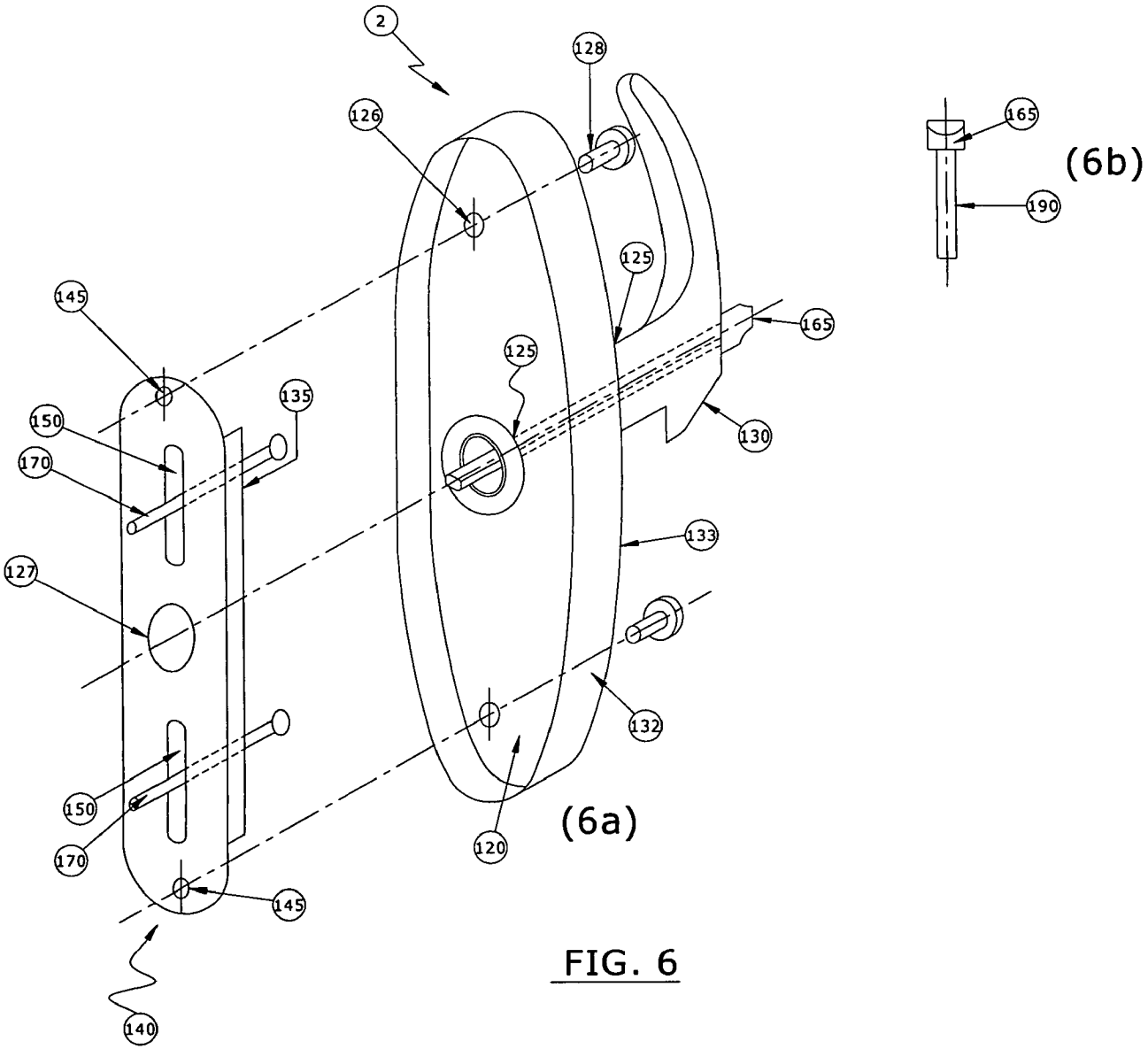
FIG. 6(*a*) is a partially exploded perspective view of the second door handle assembly with mounting bracket and locking mechanism.

Turning to FIGS. 5-6, the first door handle assembly 1, of construction as per foregoing description, is on one side of the door a fragmented section of which is designated by numeral 110, and a slotted mounting bracket 140 and a second door handle assembly 2, as hereinafter described, are provided on the other side of the door. The door has a pair of holes 111, which correspond to the alignment and spacing between the mounting studs 51. The aperture 112 in the door is in alignment with the opening 11 of the handle escutcheon and also dimensionally matches with the diameter of the longer portion of spindle 180. Aperture 112 is smaller than locking collar member 185 (FIG. 1) of the locking mechanism 160 such that the spindle 180 remains with the first handle assembly 1.

The second door handle assembly 2 comprises a handle escutcheon 120 having an aperture 125 therethrough, a manually engageable handle 130 rotatable about an axis and a locking mechanism 160 inside the handle 130. The locking mechanism 160 has a shape that prevents rotation in the manually engageable handle 130. The knob member 165 is rotatable through 90° and has an extended rectangular shaft member 190. The opening 125 is in alignment with the opening in the mounting bracket 140 and is also in alignment with the opening 11 in the first handle escutcheon 10 and opening 21 in the handle 20. The second handle escutcheon 120 has a pair of apertures 126 near its two ends through which fasteners 128 can be passed for fixing the second handle assembly 2 to the slotted mounting bracket.

A pair of externally threaded fasteners 170 pass through elongated slots the 150 in the mounting bracket 140, cooperating with internally threaded mounting studs 51. The heads of the cooperating fasteners 170 are unobstructed in the recess available between the surface of the mounting bracket 140 and the inner side of the planar surface 133 of the handle escutcheon 120 of the second door handle assembly. The cooperating fasteners 170 are positioned to be in alignment with the spaced apertures 111 in the door and the threads tightened to secure the first handle assembly 1 and the mounting plate 140 to the door 110.

Figure 7:
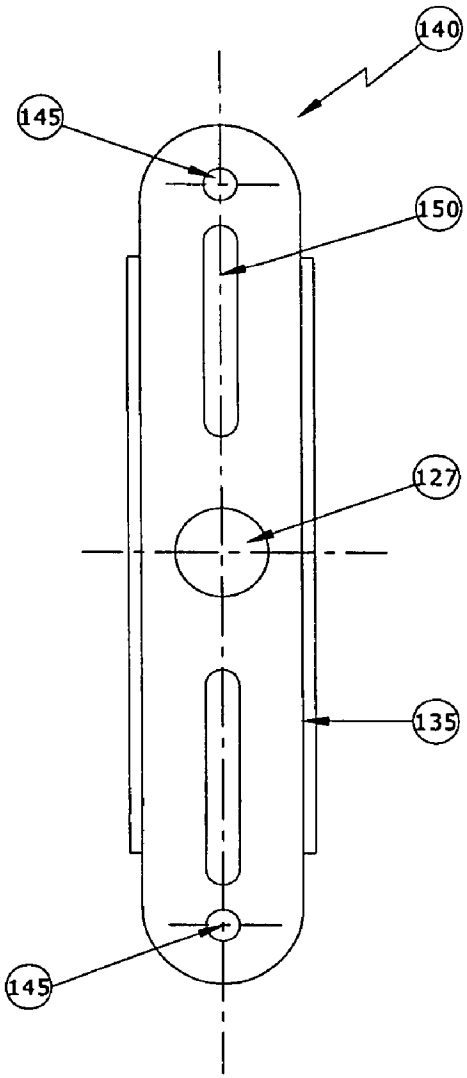
FIG. 7 is the side elevation view of the mounting bracket.

Referring to FIG. 7, the mounting bracket 140 is cooperatively configured and dimensioned to be covered by the cavity formed by the side wall 132 and planar surface 133 of the handle escutcheon 120. The mounting bracket has a pair of elongated slots 150, which are equidistant from the axis of aperture 125. The stiffening flanges 135 are provided on each planar side of the mounting bracket. The mounting bracket 140 has a pair of internally threaded apertures 145 near its two ends, which are in alignment with the pair of aperture 126 of the second handle escutcheon 120.

In installing the door handle assembly of the foregoing embodiment, the diameter and spacing between the holes in a door is first determined and the central aperture in the door 112 corrected if necessary. The main spindle 160 is securely fixed in the first handle assembly 1 with the flattened surface 189 aligned with the flattened surface of the handle aperture 12. The mounting studs 51 are adjusted and located in the required locking region of the positioning plate 40, corresponding to the predetermined spacing between the holes in the door where the door handle assembly is to be installed by pressing the stud toward the planer surface 31, sliding to the proper locking region and allowing the spring 57 to secure the stud in place. The first door handle assembly 1 is placed adjacent to the external side of the door 110 with the mounting studs 51 thus locked, and aligned with the holes 111 of the door and the spindle 160 is aligned with the hole 112 of the door. The mounting bracket 140 is placed over the spindle 160 with the stiffening flanges 135 away from the door surface. The elongated slots 150 in the mounting bracket 140 are aligned with the threaded holes in the mounting studs and the fasteners 170 are tightened to secure the first handle and the mounting bracket in place on opposite sides of the door 110. The second door handle assembly 2 is placed on the inner side of the door, inserting the shaft member 190 into the hollow portion of spindle 180 of the lock mechanism 160. The second door handle assembly 2 is then fixed to the mounting bracket 140 by means of fasteners 128 screwed through the aligned holes 126 in handle mount 120 and into internally threaded apertures 145.

In another embodiment of the present invention, the door handle assembly comprises a handle mount 10 having an opening therethrough, a manually engageable handle rotatable about an axis aligned with the opening, and a positioning plate fixed relative to the handle escutcheon. The positioning plate has a plurality of locking regions defined by locking surfaces at predefined distances from the axis. A mounting stud is provided in the recess between the positioning plate and the inner planar surface of the handle mount 10. The mounting stud has locking surfaces that are capable of being engaged with the locking surface of the positioning plate. The mounting stud is adjustable relative to the positioning plate and can be selectively fixed at any of the locking regions at a desired predetermined distance from the axis.

According to still another embodiment, there is provided a door latch assembly comprising first door handle assembly, a second door handle assembly and a locking mechanism. Each door handle assembly has a handle escutcheon having an opening therethrough and a manually engageable handle rotatable about an axis aligned with the axis of opening. The first door handle assembly has a positioning plate fixed to handle mount and plurality of pairs of locking regions, with the first pair of locking region being 1.5" apart, the second pair of locking region being 1.75" apart and the third pair of locking region being 3" apart. In the recess between the positioning plate and inner surface of handle escutcheon 10, a pair of mounting studs is provided which are internally threaded and are capable of being adjusted and fixed in any of the locking regions. Whereas the second door handle assembly encloses a slotted mounting bracket through which a pair of externally threaded cooperating fasteners extend. The fasteners can be adjusted in the slots of the mounting bracket to bring in alignment with the internally threaded mounting studs of the first door handle assembly and can be threadably engaged with each other, thereby interconnecting the two door handle assemblies.

As will be appreciated, various materials may be employed for the fabrication of the door handle assembly of the present invention. Most conveniently, the door handle assemblies are metal castings, which can be cast and can be decoratively textured or patterned on its surface. The springs used in the assembly are made of spring steel and the positioning plates and mounting brackets are fabricated from steel sheet.

Thus, it can be seen from the foregoing detailed description and the illustrative accompanying drawings that the door handle assembly of the present invention can be readily aligned with the existing holes in a door, irrespective of the standard spacing between the holes found on different doors. The handle can be conveniently and quickly installed on the door by installing two pair of fasteners, thereby obviating the need for skilled worker for drilling holes in a door.

What is claimed is:

1. A door handle assembly, comprising:

a handle mount having an opening therethrough;

a manually engageable handle rotatable about an axis, said axis aligned with said opening;

a positioning structure fixed relative to said handle mount, said positioning structure having a plurality of associated pairs of locking regions defined by locking surfaces, a locking region of each associated pair being on one side of said axis and the other locking region of each associated pair being on the other side of said axis, and each of said associated pairs of locking regions being spaced at a different predefined distance from said axis; and a pair of mounting studs, said mounting studs adapted to extend through an associated pair of apertures in a door, said mounting studs having lock surfaces that are selectively engageable with said spaced locking surfaces of said positioning structure to enable said elongated mounting studs to be selectively fixed relative to said positioning structure at desired predetermined distances from said axis, further comprising a spring operatively connected with each stud, said spring operating to retain said lock surfaces of said stud in engagement with said locking surfaces of said locking regions.

2. A door handle assembly according to claim 1, wherein said lock surfaces of each stud are formed on a peripheral surface of said stud, wherein the locking surfaces of each locking region have a shape complementary to the shape of the lock surfaces of the stud for receiving the lock surfaces of the stud.

3. A door handle assembly according to claim 1, wherein said associated pairs of locking regions include a first pair of locking regions disposed approximately 1.5" apart, a second pair of locking regions disposed approximately 1.75" apart, and a third pair of locking regions disposed approximately 3.0" apart.

4. A door handle assembly according to claim 3, wherein the two locking regions within each pair of locking regions are equidistant from said axis.

5. A door handle assembly according to claim 1, further comprising a pair of elongated slots, each of said slots provided on opposite sides of said axis and equidistant from said axis, said elongated slots having said associated pairs of locking regions provided therein, and wherein said locking surfaces of the locking regions extend beyond a periphery of said elongated slots.

6. A door assembly, comprising:

a door having opposite sides and a pair of spaced apertures therethrough, said apertures being spaced either approximately 1.5", 1.75" or 3.0" from each other, said door further having a central aperture;

a door latch assembly mounted on said door and including:

i) a first door handle assembly mounted on a first side of said door comprising:

a handle mount having an opening therethrough;

a manually engageable handle rotatable about an axis, said axis aligned with said opening;

a positioning structure arranged to be fixed relative to said handle mount, said positioning structure having a plurality of pairs of locking regions defined by locking surfaces, wherein a first pair of said locking regions is disposed approximately 1.5" apart, a second pair of said locking regions is disposed approximately 1.75" apart and a third pair of said locking regions is disposed approximately 3.0" apart to enable a pair of mounting studs to be fixed relative to said positioning structure at a selected distance from one another corresponding to the distance between the spaced apertures in the door;

the pair of mounting studs, said mounting studs adapted to extend through an associated pair of apertures in a door, said mounting studs having lock surfaces that are selectively engageable with said spaced locking surfaces of said positioning structure to enable said mounting studs to be selectively fixed relative to said positioning structure at desired predetermined distances from said axis; and ii) a second door handle assembly mounted on a second side of said door, opposite said first side, and having a pair of cooperating studs that can be aligned with the spaced apertures in the door and fixed to the studs of the first door handle assembly.

7. A door assembly according to claim 6, wherein the mounting studs of the first door handle assembly are internally threaded and the cooperating studs of the second door assembly are externally threaded.

8. A door assembly according to claim 6, wherein said second door handle assembly comprises a handle mount, a manually engageable handle rotatable about an axis, and a slotted mounting bracket through which said cooperating studs extend, said slotted mounting bracket having slots that enable said cooperating studs to move therealong to be aligned with the spaced apertures in the door to be fixed to said mounting studs of the first door handle assembly.

9. A door assembly according to claim 8, wherein said handle mount of said second door handle assembly has openings therethrough that can be aligned with openings in said slotted mounting bracket to enable fasteners to extend through the aligned openings and secure the handle mount of the second door handle assembly to the slotted mounting bracket.

10. A door assembly according to claim 9, further comprising a lock assembly constructed and managed to extend through said central aperture and interconnected between said first door handle assembly and said second door handle assembly; said lock assembly being movable between a locking condition preventing rotation of said manually engageable handles relative to said door and a releasing conditioning enabling said manually engageable handle to be rotated relative to said door.

11. A door handle assembly according to claim 9, wherein the openings in the slotted mounting bracket are threaded to receive said fasteners.

12. A door handle assembly, comprising:

a handle mount having an opening therethrough;

a manually engageable handle rotatable about an axis, said axis aligned with said opening;

a positioning structure fixed relative to said handle mount, said positioning structure having a plurality of associated pairs of locking regions defined by locking surfaces, a locking region of each associated pair being on one side of said axis and the other locking region of each associated pair being on the other side of said axis, and each of said associated pairs of locking regions being spaced at a different predefined distance from said axis; and a first mounting stud having lock surfaces that are engageable with a selected locking surface of said positioning structure to enable the first mounting stud to be selectively fixed relative to the positioning structure at a desired predetermined distance from said axis, a second mounting stud having lock surfaces that are engageable with second selected locking surfaces of said positioning structure to enable the second mounting stud to be selectively fixed relative to the positioning structure on a side of said axis opposite a side of the axis on which said first mounting stud is disposed, and wherein respective said associated pairs of locking regions of said positioning structure are spaced 1.5" apart, 1.75" apart and 3.0" apart and each region of a respective pair is equidistant to said axis.

13. A door handle assembly according to claim 12, further comprising a pair of elongated slots, each of said slots provided on opposite sides of said axis and equidistant from said axis, said elongated slots having said associated pairs of locking regions provided therein, and wherein said locking surfaces of the locking regions extend beyond a periphery of said elongated slots.

14. A door latch assembly, comprising:

i) a first door handle assembly, comprising:

a handle mount having an opening therethrough;

a manually engageable handle rotatable about an axis, said axis aligned with said opening;

a positioning structure arranged to be fixed relative to said handle mount, said positioning structure having a plurality of pairs of locking regions defined by locking surfaces, wherein a first pair of said locking regions is disposed approximately 1.5" apart, a second pair of said locking regions is disposed approximately 1.75" apart and a third pair of said locking regions is disposed approximately 3.0" apart to enable a pair of mounting studs to be fixed relative to said positioning structure at a selected distance from one another;

the pair of mounting studs having lock surfaces that are selectively engageable with said spaced locking surfaces of said positioning structure to enable said mounting studs to be selectively fixed relative to said positioning structure at desired predetermined distances from said axis; and ii) a second door handle assembly having a pair of cooperating studs adapted to be fixed to the studs of the first door handle assembly; said second door handle assembly comprises a handle mount, a manually engageable handle rotatable about an axis, and a slotted mounting bracket through which said cooperating studs extend, said slotted, mounting bracket having slots that enable said cooperating studs to move therealong to be aligned with the mounting studs of the first door handle assembly.

* * * * *